United States Patent [19]

Beckers

[11] Patent Number: 5,060,347

[45] Date of Patent: Oct. 29, 1991

[54] PROCESS AND DEVICE FOR THE MANUFACTURE OF NON-WOVEN FABRICS

[75] Inventor: Michel F. M. J. A. D. Beckers, Verviers, Belgium

[73] Assignee: S.A. des Ateliers Houget Duesberg Bosson, Verviers, Belgium

[21] Appl. No.: 440,688

[22] Filed: Nov. 24, 1989

[30] Foreign Application Priority Data

Nov. 30, 1988 [BE] Belgium ..... 8801349

[51] Int. Cl.[5] ..... D01G 25/00

[52] U.S. Cl. ..... 19/300; 19/163; 19/296; 28/101

[58] Field of Search ..... 19/144, 296, 300, 302, 19/161.1, 163; 28/100, 101, 104, 107, 114, 117

[56] References Cited

U.S. PATENT DOCUMENTS

| | | | |
|---|---|---|---|
| 2,933,774 | 4/1960 | Adams, Jr. | 19/144 |
| 3,183,557 | 5/1965 | Holowell | 19/163 |
| 3,523,059 | 8/1970 | Coates | 28/121 |
| 3,883,333 | 5/1975 | Ackley | 65/2 |
| 3,920,511 | 11/1975 | Grieves et al. | 28/107 |
| 4,107,822 | 8/1978 | Brown | 19/163 |
| 4,186,470 | 2/1980 | Stoller | 19/161.1 |
| 4,187,586 | 2/1980 | Semjonow | 19/161.1 |
| 4,481,694 | 11/1984 | Dilo | 19/296 |
| 4,701,986 | 10/1987 | Günther et al. | 28/114 |
| 4,747,188 | 5/1988 | Cooper et al. | 19/300 |
| 4,878,278 | 11/1989 | Hsu et al. | 28/114 |

FOREIGN PATENT DOCUMENTS

| | | | |
|---|---|---|---|
| 1129623 | 1/1957 | France | 28/107 |
| 1299112 | 6/1962 | France . | |
| 1099594 | 1/1968 | United Kingdom . | |

*Primary Examiner*—Werner H. Schroeder
*Assistant Examiner*—Michael A. Neas
*Attorney, Agent, or Firm*—Walter H. Schneider

[57] ABSTRACT

Non-woven fabrics are manufactured using a carding machine with outlet comb, a blamire feed or spreader/-batt-making machine with cylinders for depositing a web of fibers, and one or more needling devices. The surface weight of the web delivered by the carding machine to the blamire feed is modified by varying the speed of the comb as a function of the changing positions of the cylinders whereby a batt of variable surface weight over its width is obtained so as to counteract the distortions of surface weight distribution produced by the needling devices.

12 Claims, 4 Drawing Sheets

3.3.
3.2.
3.1.
WEIGHT OF SAMPLE
POSITION OF SAMPLE ON WIDTH OF BATT 4.3.
4.2.
4.1.
WEIGHT OF SAMPLE
POSITION OF SAMPLE ON WIDTH OF BATT

PROCESS AND DEVICE FOR THE MANUFACTURE OF NON-WOVEN FABRICS

BACKGROUND OF THE INVENTION

1. Field of the Invention

This invention relates to a production line for nonwoven fabrics obtained by needling.

A production line for non-woven fabrics by needling generally comprises the following machines:

a carding machine
a blamire feed or spreader/batt-making machine
a pre-needling device
one or more needling devices
a winding device
subsequent manufacturing stages such as sizing, latexing etc.

2. Description of the Prior Art

The purpose of the carding machine is to produce a light, coherent, but delicate web from the individual fibres.

The purpose of the blamire feed is to lay this web in several superposed and progressively staggered layers, in order to achieve a lap or batt with a higher surface weight.

The purpose of the needling devices is to consolidate this lap through the interpenetration of the fibres and layers. Boards provided with very large numbers of vertical needles regularly strike down on the fibre lap passing horizontally below these needle boards. Fibres of the upper layers are carried by the needles towards the lower layers, and the result is a felting effect which gives the lap greater resistance, this resistance depending greatly on the density of penetration of the needles into the batt.

The winder receives the needled product and takes it, in the form of rolls adapted to the conveyance, to the subsequent manufacturing stages.

During needling of the batt supplied by the blamire feed, this batt undergoes changes as regards the distribution of the fibres.

The voluminal density of the material thus increases as the needling proceeds, so that the thickness of the batt is greatly reduced by the interpenetration of the fibres of the different layers.

Another type of distortion is often found in practice, namely a final uneven distribution over the width of the batt. It is thus found that the surface weight of the non-woven fabric on leaving the last needling device is lower at the centre of the batt than at the edges and that in fact, if samples of batt are taken across the whole width of the product, the curve giving the weight of the samples as a function of the position across the width of the batt is a more or less regular V-shape. The real shape of this curve, which will be called the V-curve below, depends, of course, on numerous factors, such as the type of fibres, weight of the batt, needling density etc.

The well-known disadvantage of this distortion of the batt is that the batt is sold by surface weight, and that the purchaser often considers as the price basis the minimum weight obtained from pre-washed samples across the width of the non-woven fabric. This is according to the criterion that a surplus of material often corresponds to an improvement in the product, and that the latter therefore can only be resold according to the least heavy zones of the product; without this attitude, the least heavy zones could be considered weak points and thus faults in the product, which would not then be top quality.

In considering the weight of the least heavy zones as the normal weight of the product, all the material present in the other zones, the weight of which exceeds that of the least heavy zones, constitutes lost material for the producer, since he cannot charge its value in the price which he charges the purchaser.

The V-shape obtained at the end of the production line thus constitutes a cause of loss of profitability in the process, which producers are obviously trying to minimize, but without being able to manage this perfectly.

SUMMARY OF THE INVENTION

The object of the present invention is to provide producers with an additional and effective means of reducing the losses of material by creating a better sectional regularity of the product emerging from the needling devices.

The method involves producing artificially, by the carding machine and the blamire feed, a batt whose weight varies over the width approximately in inverse proportion to the weight distribution which would be obtained at the outlet of the needling devices in the traditional process.

In other words, arrangements are made to obtain at the outlet of the blamire feed a batt which is thicker at the centre than at the edges, and of which the weight curve of samples taken over the entire width exhibits the appearance of an inverted V, which we shall call the inverted V-curve below.

In this way, the distortion occurring during the needling operation is going to counteract the weight irregularity which was deliberately produced in the blamire feed, and these two effects are at least going to detract from each other, if not cancel each other out. The result is then a more regular needled batt, which is flatter than that produced by traditional systems.

The method of achieving the invention will be explained below.

The process constituting the object of the invention can be described as follows.

DESCRIPTION OF THE PREFERRED EMBODIMENT

Figure 1:
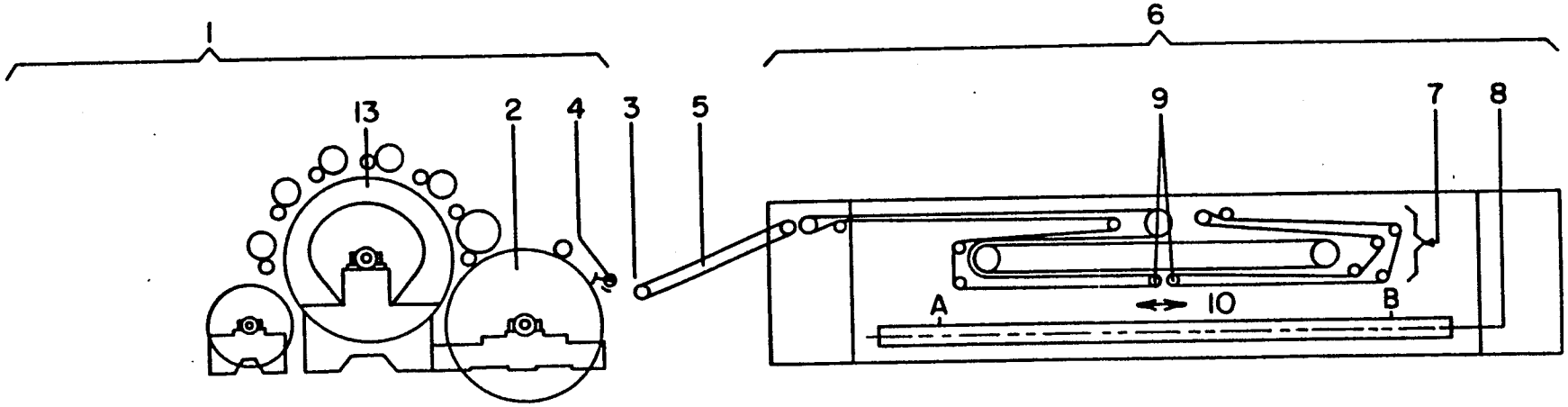
FIG. 1 shows in section the discharge from a carding machine and the circuit of a blamire feed.

FIG. 1 shows a section of the discharge from a carding machine 1, a machine which is well-known in textile circles. The last drum 2 is the comb which delivers the final web 3 from the carding machine, said web being detached from the comb 2 by the doffer 4.

This web is deposited on a conveyor belt 5 which conveys it to the blamire feed 6. The latter, by means of other conveyor belts 7, and following a circuit of which there are numerous variants in the industry, conveys the web to another conveyor belt 8 which is disposed underneath the conveyor belts 7 and whose direction of travel 11 (FIG. 2) is at an angle of 90 degrees relative to the direction to travel 10 of the conveyor belts 7.

The feed cylinders 9 move alternately from end A to end B of the conveyor belt 8.

Figure 2:
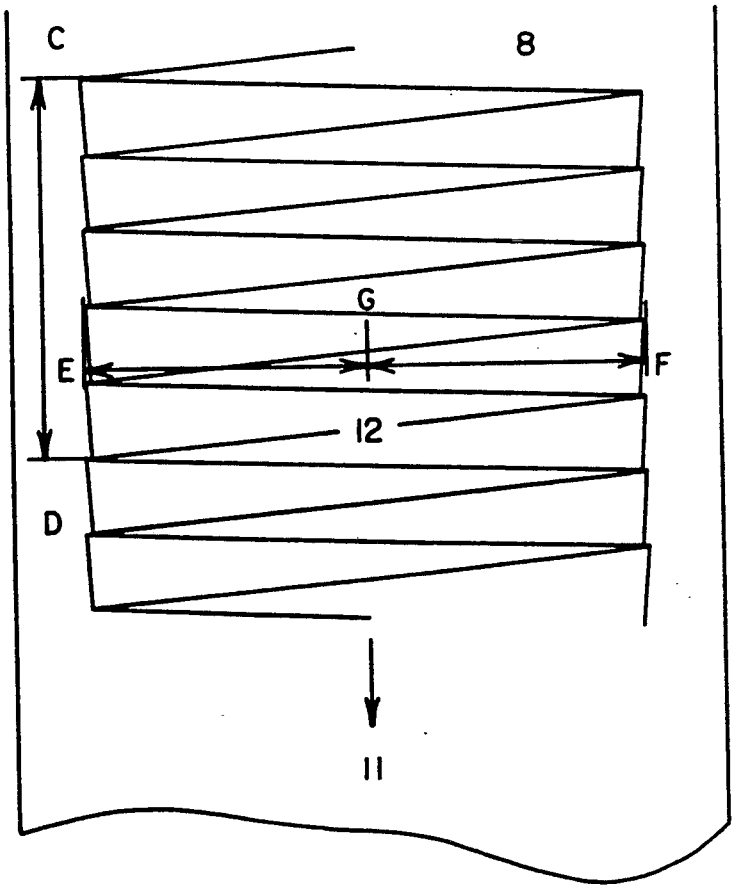
FIG. 2 shows a plan view of the arrangement of the layers delivered by the carding machine to make up the batt at the outlet of the blamire feed.

FIG. 2 shows how the layers are deposited on the conveyor belt 8. The number of to-and-fro movements made by the cylinders 9 while the conveyor belt 8 is moving from C to D is a whole number, so that the edges of the successive layers coincide and the batt is an equal weight at every point.

A certain overthickness can exist at the edges of the batt at ends E and F, due to the fact that during the reversal at these ends the cylinders 9 undergo a deceleration, then an acceleration and translation, while the rotation remains constant. This fault, which is well-known in the industry, is not the subject of the present invention and will not be discussed below; only the central part, which constitutes the vast majority of the product, in which the surface weight is constant in the traditional technology, will be considered.

Figure 3:
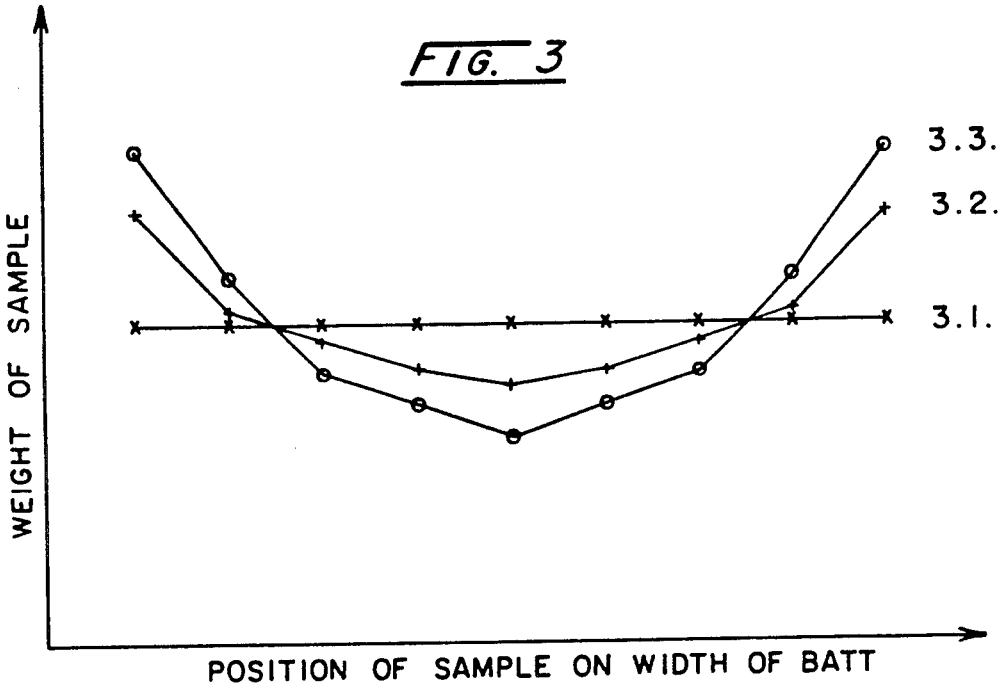
FIG. 3 shows the development of the curve of the surface weight of the material over the width of the batt, after the different machines of the production line, in the traditional process.

If a strip is cut from the batt 12 coming out of the blamire feed, at right angles to the direction of forward movement 11 of this batt, and this strip is cut into samples of equal dimensions, and these samples are weighed and a curve is plotted in which the x-axis represents the position of the sample on the width of the batt, and the y-axis represents the weight of the sample, a curve 3.1 such as that shown in FIG. 3 is obtained.

If this operation is repeated for the batt coming out of the pre-needling device, a curve 3.2 such as that shown in FIG. 3 is obtained.

At the outlet of the needling device, the curve 3.3 found is of a shape such as that shown in FIG. 3.

Although not well-known, the cause of this phenomenon is attributed to the following fact. A certain tension is necessary for pulling the batt across a needling device. This tension is accompanied, on the one hand, by an elongation of the batt in the direction of forward movement and, on the other, by a subsequent shrinking of the batt in the perpendicular direction, as is the case for any body submitted to traction.

Now, the nearer a fibre is to the end E or F of the batt, the freer it is, since it is less well integrated in the heart of the batt, thus the more this fibre has a tendency to migrate towards the centre, owing to the traction. The compression and thus the lateral densifying of the batt therefore takes place increasingly as one goes further away from the centre of the batt. The surface weight of the batt thus increases as one goes away from the centre of the batt towards its ends, which explains the weight curves of FIG. 3.

The object of the present invention is to restore a constant weight distribution across the width of the batt at the outlet of the last needling device.

In order to achieve this, a periodic variation of the weight of the web coming out of the carding machine is produced artificially, in order to obtain at the outlet of the blamire feed a batt which is higher in weight at the centre than at the ends. The object is to obtain on the conveyor belt 8 a batt whose weight curve across the width is of the shape of curve 4.1 shown in FIG. 4.

Figure 5:
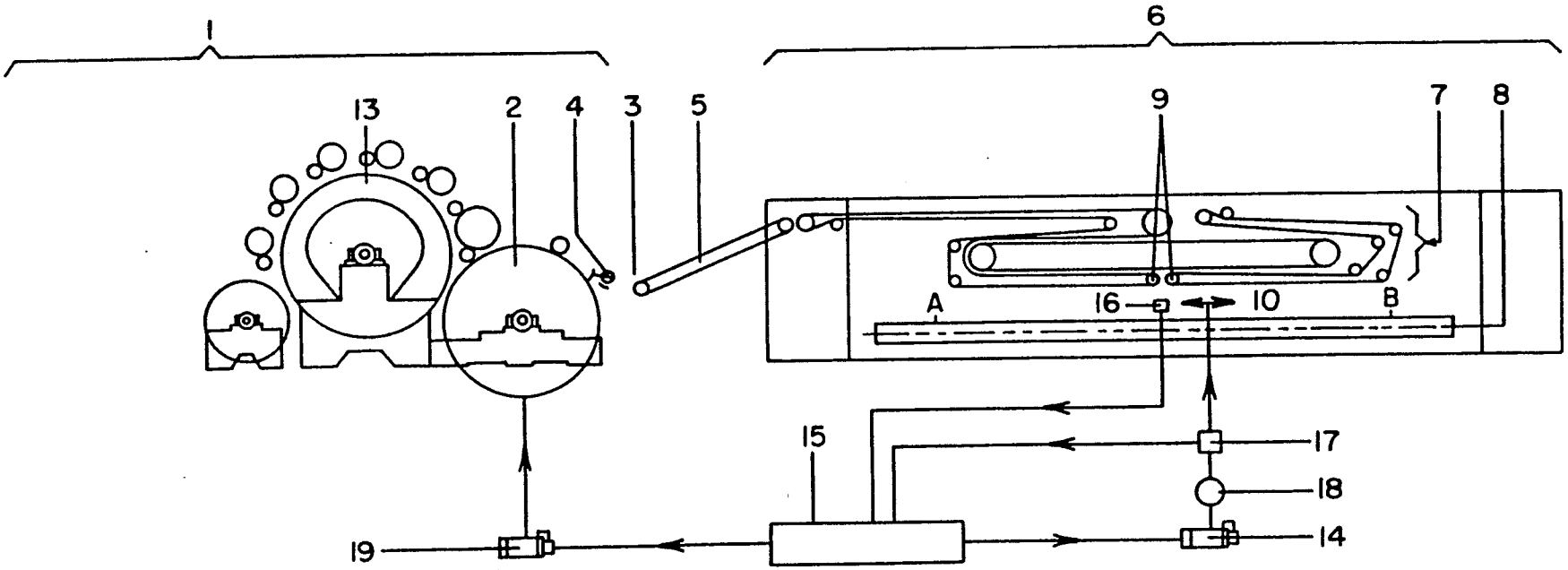
FIG. 5 shows the principle of the system which is the object of the invention.

In order to do this, and as shown in FIG. 5, the speed of rotation of the comb is manipulated, since it is well-known that the ratio between the circumferential speeds of the comb 2 and of the drum 13 determines the weight of the web. Thus, if the drum is turning at a speed of $V_t$ meters per minute and carrying a surface load of fibres of M grammes per square meter and the comb is turning at a speed of $V_p$ meters per minute, and assuming that the comb takes all the material from the drum, the surface load of the fibres on the comb, and thus the web delivered by the carding machine, will have a surface weight of $N=(V_t/V_p)\times M$ grammes per square meter.

Therefore, if the speed of the comb is increased, the weight of the web is reduced, and if it is decreased, the weight of the web is increased.

If the speed of the comb is varied at regular intervals, a web whose weight also varies at regular intervals with the same frequency is obtained. The surface weight of the web delivered by the carding machine is modified in a permanent manner according to a periodic rule by action on the speed of the outlet comb in such a way that a batt of variable surface weight over tis width is obtained at the discharge from the superposition machine.

The frequency selected for the variation of the speed of the comb is obviously the frequency of the to-and-fro movement of the cylinders 9. When the cylinders are at the centre of the batt, the weight of the web deposited on the conveyor belt 8 must be the maximum. When the cylinders are at one of the ends E or F, the weight of the web deposited on the conveyor belt 8 must be the minimum. Between these extreme positions, the weight of the web can vary according to any curve which can be selected according to experience; in particular, this curve can be a straight line.

It is easy, by placing a movement pick-up 17 on the cylinders 9, which preferably is a detection system comprising an optical coder, to know the position of these cylinders at any moment and, on the basis of this information, to control the speed of the comb 2 by means of a speed variation system 19 comprising either a direct current motor and an electronic variator with thyristors and/or transistors, or an alternating current motor and an electronic frequency variator.

However, there is one problem which has to be overcome. The moment at which the cylinders 9 are at the centre of the batt and the moment at which the comb 2 is at its minimum speed, i.e. is delivering a web of maximum weight, cannot coincide, for account has to be taken of the time which the web takes to go from the point at which it comes away from the comb 2 to the point at which it is deposited on the conveyor belt 8. A certain delay then has to be introduced into the speed regulation of the comb, in relation to the detection of the position of the cylinders 9.

This delay constitutes an additional parameter of the system, which can easily be taken into account using a calculating system comprising a computer 15 to regulate the speed of the comb 2 as a function of the position of the cylinders 9. The computer 15 receives the information concerning the position of the cylinders 9 from the pick-up 17, calculates the corresponding speed of the comb 2, but does not send the instruction corresponding to the control of the motor 19 of the comb until after the delay which has been determined. This delay can be determined by calculation, or experimentally.

Figure 4:
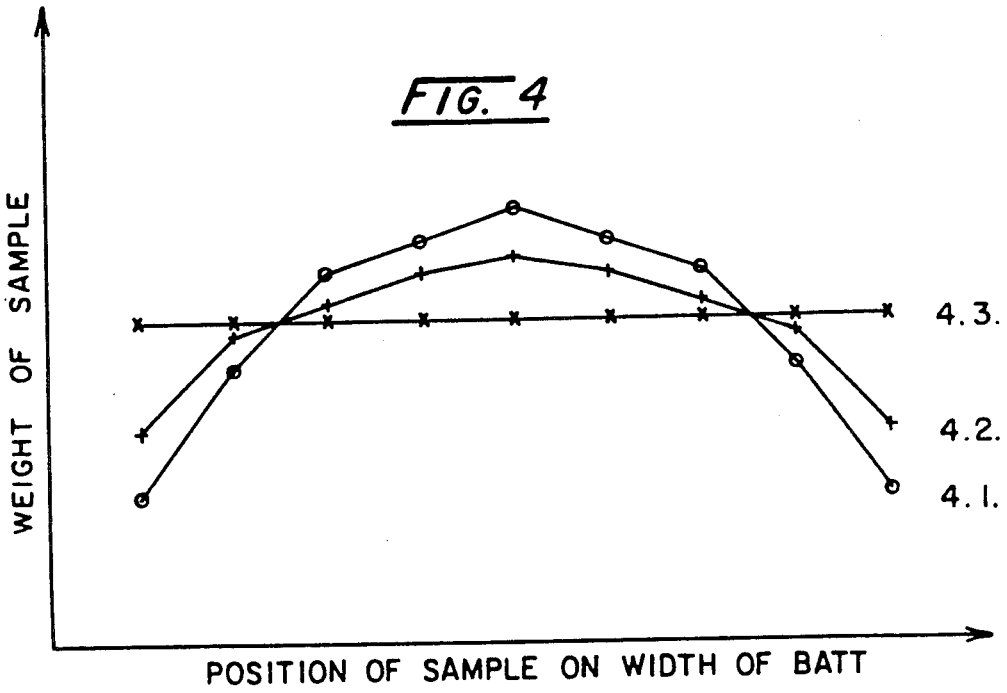
FIG. 4 shows the curve of the surface weight at the outlet of the blamire feed, obtained by the system which is the object of the invention, and the theoretical development of this curve after the needling devices.

With the system described above, a weight curve of the batt after blamire feed is obtained having an inverted V-shape 4.1 as shown in FIG. 4.

The action of the pre-needling device, instead of creating a distortion in a V-shape, reduces the amplitude of the inverted V-curve, and a weight curve 4.2 of the type shown in FIG. 4. is obtained at the outlet of the pre-needling device.

The action of the needling device also reduces the amplitude of the inverted V, and at the outlet a weight curve 4.3 of the type shown in FIG. 4 is obtained, which is in fact the objective of the producer of non-woven fabrics, namely to obtain a product which is as flat as possible on emerging from the production line.

The result sought can be achieved in various ways, of which we give one example below.

In this example the movement of the cylinders 9 is achieved by a system comprising chains for translation, these chains being driven by chain wheels 18, themselves controlled by a direct current motor 14. The motor 14 is controlled by a computer 15, which calculates its speed and, as soon as the cylinders 9 have achieved the translation course necessary for achieving the width of batt desired, commands it to brake in a very short time and to reverse its direction of rotation, i.e. the direction of movement and translation of the cylinders 9.

A pick-up 16 placed at the centre of the conveyor belt 8 gives the computer the centre point G of the batt (FIG. 2). The operator chooses on the computer the width of the batt GE or GF which he wishes from each side of this centre point.

An incremental optical coder 17 is placed on the chain wheel 18, said coder permanently supplying the computer 15 with an indication of the position of the cylinders 9. Knowing that the centre point G of the batt, given by the pick-up 16, represents the point where the web 12 deposited should be the heaviest, and that the end points E and F, calculated by the computer 15, represent the points where the web should be the lightest, the computer can calculate at any moment the speed of the comb 2 to obtain the weight of web desired. For this, the value of the weight of web which is wanted at the centre or at the ends and the curve of the weights which one wishes to follow must be entered in the computer.

The invention also covers all the other achievements of which the object would be to vary the speed of the carding machine comb 2 at regular intervals, with the object of obtaining at the outlet of the blamire feed 6 a batt whose weight is deliberately irregular, so that the effect of destroying the regularity of the weight of the batt normally produced by the needling devices or the machines following the blamire feed is counteracted.

The invention also covers those cases where the blamire feed is replaced by another machine for the purpose of superposing several layers of web in order to achieve a thicker batt. We shall call these machines "superposition machines".

The invention also covers those cases where the needling devices are replaced by other machines intended for consolidating the batt or carrying out a treatment of some kind or other on said batt. We shall call these machines "consolidation machines".

We claim:

1. A device for manufacturing non-woven fabrics comprising a carding machine (1) with an outlet comb (2), a superposition machine (6) with cylinders (9) for depositing a web, and at least one consolidation machine, characterized in that the superposition machine (6) comprises a detection system (17) for the position of the cylinders (9) depositing the web, a calculation system (15) for the speed of the comb (2) depending on the position of cylinders (9), and a speed variation system (19) for the comb (2) depending on the result of the calculation system (15).

2. A device according to claim 1 characterized in that the detection system (17) for the position of cylinders (9) is an optical coder for giving a signal proportional to the position of cylinders (9).

3. Device according to claim 1, characterized in that the calculation system (15) is a computer which receives the signal corresponding to the position of the cylinders (9), calculates the speed variation of the comb (2) as a result of said position, calculates the delay after which said speed variation should have taken place, and sends a corresponding electronic signal to the speed variation system (19) of the comb (2).

4. Device according to claim 2, characterized in that the speed variation system (19) of the comb (2) comprises a direct current motor and an electronic variator with means selected from thyristors and transistors.

5. Device according to claim 2, characterized in that the speed variator system (19) of the comb (2) comprises an alternating current motor and an electronic frequency variator.

6. A device according to claim 1 in which the superposition machine is a blamire feed machine and the consolidation machine is a needling device.

7. A device according to claim 1 in which the superposition machine is a spreader/batt-making machine and the consolidation machine is a needling machine.

8. A device according to claim 2 in which the optical coder is installed in the mechanical control for shifting the cylinders (9).

9. A device according to claim 2 in which the optical coder is installed on the motor (14) for shifting the cylinders (9).

10. A process for the manufacture of non-woven fabrics using a carding machine (1) with an outlet comb (2) to produce a web for delivery to a superposition machine (6) with to- and fro-moving cylinders (9) for depositing the web and at least one consolidation machine, the improvement which comprises modifying the surface weight of the web delivered by the carding machine by varying the speed of the outlet comb (2) as a function of the changing position of the cylinders (9) whereby a batt of variable surface weight over tis width is obtained at the discharge from the superposition machine thereby counteracting distortions of surface weight distribution in the batt subsequently produced by the consolidation machine.

11. A process according to claim 10 in which the superposition machine is a blamire feed machine and the consolidation machine is a needling device.

12. A process according to claim 10 in which the superposition machine is a spreader/batt-making machine and the consolidation machine is a needling machine.

* * * * *